US006375510B2

(12) United States Patent
Asao

(10) Patent No.: US 6,375,510 B2
(45) Date of Patent: Apr. 23, 2002

(54) ELECTRICAL NOISE-REDUCING ASSEMBLY AND MEMBER

(75) Inventor: Kazuhiro Asao, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/819,689

(22) Filed: Mar. 29, 2001

(30) Foreign Application Priority Data

Mar. 29, 2000 (JP) ..... 2000-091162

(51) Int. Cl.[7] ..... H01R 13/66
(52) U.S. Cl. ..... 439/620; 439/941; 439/608
(58) Field of Search ..... 439/608, 620, 439/941

(56) References Cited

U.S. PATENT DOCUMENTS

| | | | | | |
|---|---|---|---|---|---|
| 3,702,422 | A | | 11/1972 | Schor | 361/773 |
| 4,126,370 | A | * | 11/1978 | Nijman | 439/608 |
| 4,276,523 | A | * | 6/1981 | Boutros et al. | 333/182 |
| 4,458,220 | A | * | 7/1984 | Carter et al. | 333/182 |
| 4,507,630 | A | * | 3/1985 | Wakino | 333/182 |
| 4,753,611 | A | * | 6/1988 | Kobler | 439/578 |
| 4,820,174 | A | * | 4/1989 | Farrar et al. | 439/95 |
| 5,022,870 | A | | 6/1991 | Sakamoto et al. | 439/680 |
| 6,059,608 | A | * | 5/2000 | Benes | 439/620 |

FOREIGN PATENT DOCUMENTS

| | | |
|---|---|---|
| EP | 0 398 807 A2 | 11/1990 |
| EP | 0 969 568 A1 | 1/2000 |
| JP | 03 057176 | 3/1991 |

* cited by examiner

*Primary Examiner*—Tulsidas Patel
(74) *Attorney, Agent, or Firm*—Oliff & Berridge, PLC

(57) ABSTRACT

An electrical noise-reducing member has concentric inner and outer cylindrical portions. The outer cylindrical portion is of electrical noise-reducing magnetic material, and the inner cylindrical portion is of elastically deformable material and has a longitudinal through-hole. In use, an electrically conductive element, such as a connector terminal, is inserted into the through-hole to elastically secure the element to the noise-reducing member.

8 Claims, 4 Drawing Sheets

ELECTRICAL NOISE-REDUCING ASSEMBLY AND MEMBER

BACKGROUND OF THE INVENTION

1. Field of Invention

The present invention relates to an electrical noise-reducing assembly for reducing electrical noise in an electrical conductor, to an electrical noise-reducing member for use in such an assembly and to an electrical connector including the electrical noise-reducing member.

2. Description of Related Art

In a known electrical connector, to reduce high-frequency noise signals, such as "spikes", transmitted in a conductive element (e.g. a terminal fitting or an electrical wire), the conductive element is inserted into a cylinder of ferromagnetic material which absorbs the noise signal. A connector having such a construction is disclosed in EP-A-969568. As shown in present FIG. 4, this known connector 1 has a housing 2 made of synthetic resin and a cylindrical body of magnetic material 3 integrated with the housing 2 at the rear portion thereof by insert molding. A plurality of L-shaped terminal fittings 4 are mounted on the housing 2, with the rear portion of each terminal fitting 4 inserted into a through-hole 3A of the magnetic material 3 and extending from the rear of the housing 2. The body of magnetic material 3 acts as the noise-reducing member.

However, because the housing 2 and the magnetic material 3 are formed by insert molding, a complicated molding die is needed for the housing 2 and the magnetic material 3. Thus, the manufacturing cost of the connector 1 is high.

Alternatively, the body of magnetic material may be installed on the housing after molding, an elastically deformable lance for locking the body to the housing being formed integrally with the housing by one-piece molding. However, a complicated molding die for the connector and the lance is also needed, and thus the manufacturing cost of the connector is high.

SUMMARY OF THE INVENTION

It is an object of the present invention to provide a noise-reducing member which can be relatively easily installed on a conductive element.

In a first aspect, the present invention provides an electrical noise-reducing assembly comprising:

(i) at least one elongate electrical conductor; and (ii) an electrical noise-reducing member carried on the electrical conductor and comprising a body of magnetic material having at least one through-hole, through which the electrical conductor extends, and an elastically deformable member fixed in the through-hole and elastically gripping the electrical conductor therein so as to hold the body of magnetic material in position on the electrical conductor.

Preferably the elastically deformable member is of rubber.

The noise-reducing member is elastically secured to the conductor by inserting the conductor element into the through-hole of the elastically deformable member. Thus, noise-reducing material can be installed on the conductor by a simple operation, and a complicated construction can be avoided.

In a second aspect, the present invention provides an electrical noise-reducing member comprising concentric inner and outer cylindrical portions secured together, wherein the outer cylindrical portion is of electrical noise-reducing magnetic material, and the inner cylindrical portion is of elastically deformable material and has a longitudinal through-hole for elastically securing it to an elongate electrical conductor which, in use, is inserted into the through-hole so that electrical noise in said electrical conductor is reduced.

In a third aspect, the invention provides an electrical connector comprising an electrical terminal and an electrical noise-reducing member carried on the terminal;

the electrical noise-reducing member comprising inner and outer portions secured together, wherein the outer portion is of electrical noise-reducing magnetic material and surrounds the inner portion, and the inner portion is of elastically deformable material and has a longitudinal through-hole;

the electrical terminal being received in the through-hole to elastically secure the electrical noise-reducing member to the electrical terminal.

Preferably the body of magnetic material and the electrically deformable member are cylindrical, e.g. circularly cylindrical. Here, the word "cylindrical" is used in its proper broad sense, including not only circularly cylindrical bodies but also other cylindrical shapes, e.g. a square cylinder.

The electrical noise-reducing member may be carried on a single electrical conductor or a plurality of electrical conductors, as described below.

BRIEF DESCRIPTION OF THE DRAWINGS

Embodiments of the invention will now be described by way of non-limitative examples with reference to the accompanying drawings, in which.

DETAILED DESCRIPTION OF PREFERRED EMBODIMENTS

Figure 1:
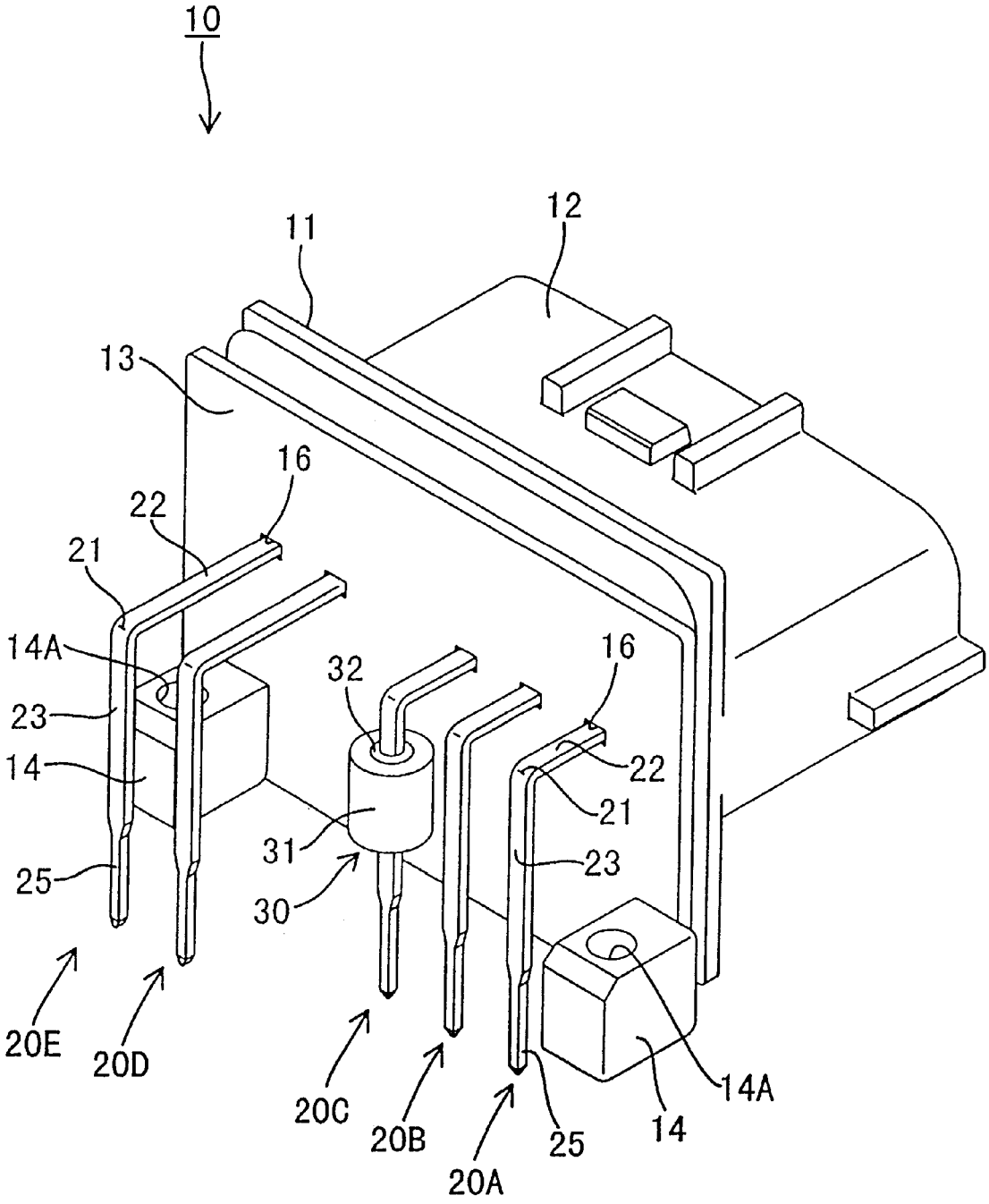
FIG. 1 is a perspective view of a connector which is an embodiment of the present invention.

As shown in FIG. 1, the connector of the embodiment of the invention has a housing 11 made of molded synthetic resin. A hood part 12 in which a mating connector (not shown) is to be fitted in use is formed on the front side of the housing 11. A flat part 13 is formed on the rear side of the housing 11. A pair of box-shaped mounting portions 14 are located at the lower end of the rear side of the flat part 13. A screw hole 14A is formed in each mounting portion 14. The housing 11 can be secured to a substrate (not shown), e.g. a vehicle body, by inserting screws into the screw holes 14A, to fix the mounting portions 14 to the substrate. The housing 11 has five terminal press-fit holes 16 formed thereon. Each terminal press-fit hole 16 extends from the bottom surface of the hood part 12 to the rear surface of the flat part 13, with the terminal press-fit hole 16 penetrating through the flat part 13. Terminal fittings 20A–20E are pressed into the terminal press-fit holes 16, respectively, to penetrate therethrough.

Each of the terminal fittings 20A–20E is formed of conductive metal sheet. The conductive metal sheet is bent in the shape of an "L" at a bend 21 to divide it into a horizontal part 22 and a vertical part 23. The terminal fittings 20A–20E have the same construction except that the horizontal part 22 of each of the terminal fittings 20D and 20E is longer than that of each of the terminal fittings 20A–20C. A tab (not shown) is formed at the front end of the horizontal part 22. The tab projects into the hood part 12 and is connectable with a female terminal fitting (not shown) accommodated inside the mating connector which is fitted in the hood part 12. A projection (not shown) is formed widthwise at a base portion of the tab and pressed into the terminal press-fit hole 16 of the housing 11. A part of the horizontal part 22 projects from the flat part 13. The vertical part 23 extends downward from the bend 21. The lower end portion of the vertical part 23 is formed as a connection part 25 which has a smaller width than the vertical part 23 and which is connectable for example with a circuit mounted on a substrate (not shown).

Figure 2:
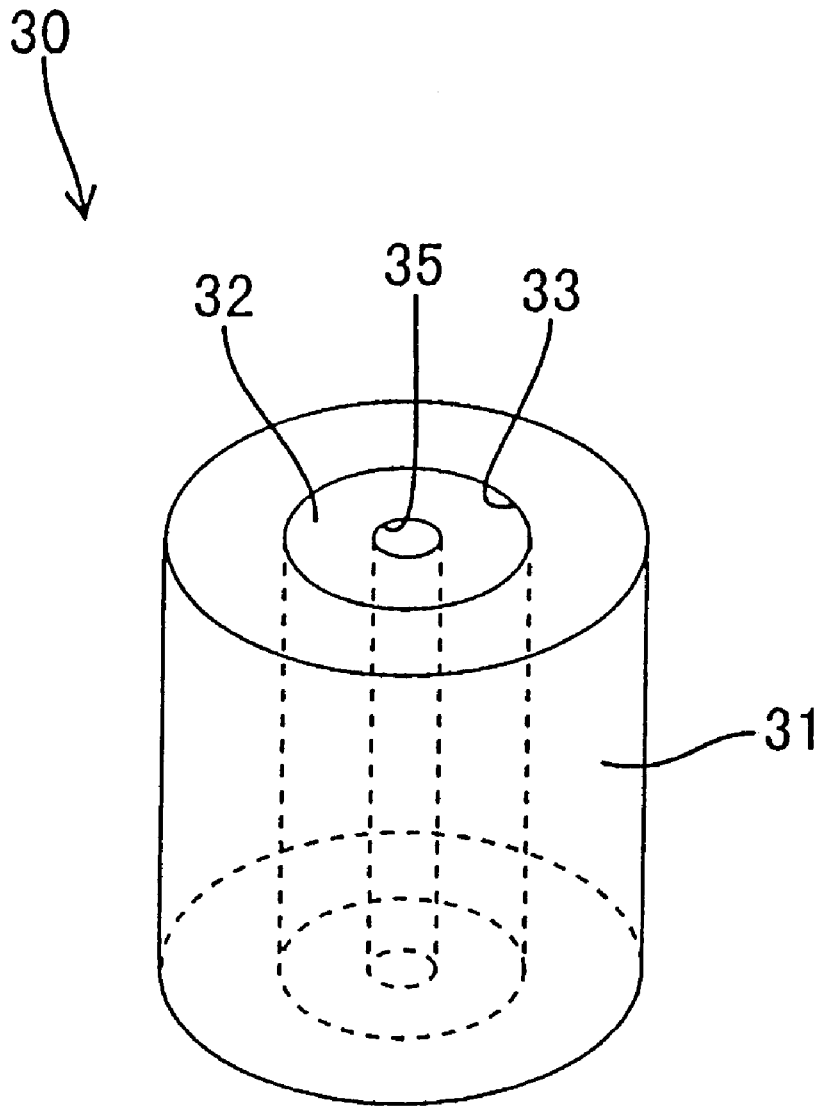
FIG. 2 is a perspective view of the noise-reducing member in the connector of FIG. 1.

An electrical noise-reducing member 30 is installed selectively on any one of the terminal fittings 20A–20E, according to need. In the embodiment, the noise-reducing member 30 is installed on the terminal fitting 20C. As shown in FIG. 2, the noise-reducing member 30 is cylindrical, in this case circularly cylindrical, and has a double construction. That is, the noise-reducing member 30 has a body of noise-reducing magnetic material 31 provided at the outer side thereof (to form an outer cylindrical portion), and an installing material 32 provided at the inner side thereof (to form an inner cylindrical portion). The installing material 32 is used to install the noise-reducing member 30 on any one of the terminal fittings 20A–20E.

The cylindrical magnetic material body 31 is made of a ferromagnetic material, such as ferrite, and has a through-hole 33. Suitable magnetic materials for this purpose are known in the art. The installing material 32 is formed cylindrically by molding an elastic material, such as a rubber, and has an installing through-hole 35 at its centre. The installing material 32 is fitted in the through-hole 33 by press-fitting. The inner diameter of the installing through-hole 35 is slightly smaller than the width of the vertical part 23 of each of the terminal fittings 20A–20E. Thus, by inserting the vertical part 23 of any one of the terminal fittings 20A–20E into the through-hole 35 by press fitting, the installing material 32 is vertically slidable on the vertical part 23 and can be elastically locked to any one of the terminal fittings 20A–20E.

To assemble the connector 10 of the embodiment, after the housing 11 is formed by molding a suitable material, the terminal fittings 20A–20E are inserted into the terminal press-fit holes 16 respectively by press fitting before bending them at the bend 21. The terminal fittings 20A–20E projecting rearward from the housing 11 are bent downward at the bending position 21 with a jig. In this manner, a semi-finished molded product having the housing 11 and the terminal fittings 20A–20E mounted thereon is obtained.

Then, the electrical noise-reducing member 30 is installed on any one (20C in the embodiment) of the terminal fittings 20A–20E of the semi-finished molded product. First, the connection part 25 of the terminal fitting 20C is inserted into the through-hole 35 of the installing material 32. Then, the noise-reducing member 30 is slid upward on the vertical part 23, and then stopped at an appropriate position. The installing material 32 elastically grips the vertical part 23. Consequently, the noise-reducing member 30 is fixed in its desired position on the terminal fitting 20C.

This completes the assembly of the connector 10. If electric current flowing through the terminal fitting 20C includes a high-frequency noise during the use of the connector 10, the magnetic material 31 absorbs the noise, achieving noise reduction.

Figure 4:
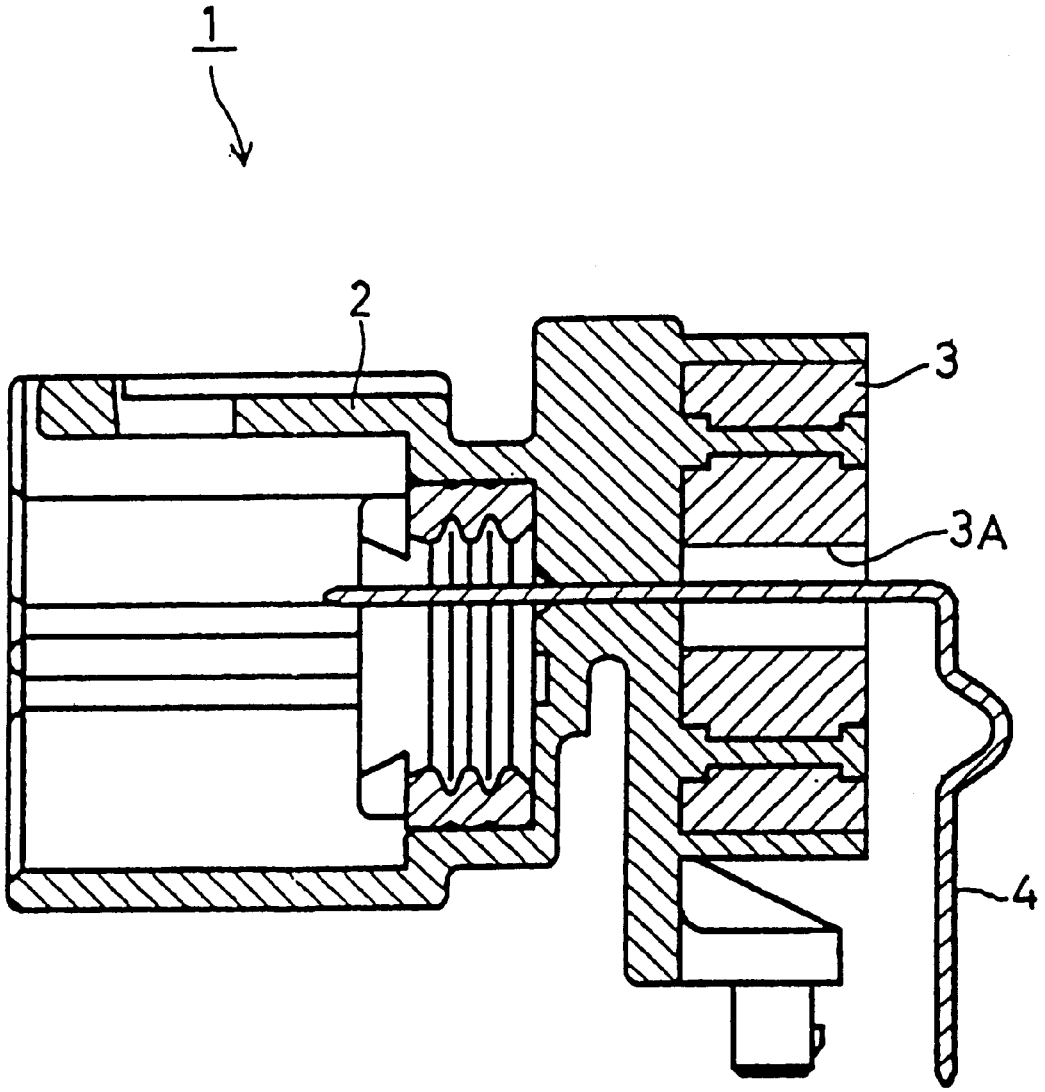
(Prior Art) Fig. 4
FIG. 4 is a sectional view showing a known connector described above.

In this embodiment, by inserting the terminal fitting 20C into the installing material 32 of the noise-reducing member 30, the installing material 32 can be elastically locked to the terminal fitting 20C. That is, the magnetic material 31 can be installed on the terminal fitting 20C in a simple manner. In comparison with the known device of FIG. 4, this eliminates the need for forming the magnetic material integrally with the housing by insert molding or forming an elastically deformable lance integrally with the housing to lock the magnetic material to the housing. Therefore, the molding die for the housing 11 can be simplified, which allows the manufacturing cost of the connector to be reduced.

Further, the installing material 32 is made of elastic material, such as rubber, and is elastically locked to any one of the terminal fittings 20A–20E inserted into the installing hole 35 by press fitting. Therefore, it is a straightforward process to install the noise-reducing member 30 on any one of the terminal fittings 20A–20E.

Further, the noise-reducing member 30 is removably installed on any one of the terminal fittings 20A–20E. Thus, for example, the noise-reducing member 30 may be installed initially on any one of the terminal fittings 20A–20E of the housing 11. However, the noise-reducing member 30 can then be transferred to any other of the terminal fittings 20A–20E at a later stage of fabrication, e.g. according to a specific noise-reducing requirement for the electrical circuit. The initial installation and later fabrication may occur at different sites, and transporting the noise-reducing member 30 carried on a terminal fitting is more convenient than transporting the noise-reducing member separately from the housing between the sites.

A typical application of the invention is in a DC electrical circuit, such as in an automobile, e.g. in a radio power circuit.

The scope of the present invention is not limited to the above-described embodiment, and the following embodiments for example are included in the scope of the present invention.

(1) In the above-described embodiment, the present invention is applicable to the connector 10 which, in use, is installed on a substrate, but the noise-reducing member of the present invention is also applicable to other kinds of connectors. In addition, the noise-reducing member may be used for installing the magnetic material on an electrical wire, the wire passing through the centre of the noise-reducing member. The wire may be a bare wire or a wire having an insulating covering gripped by the inner portion 32.

(2) In the above-described embodiment, the terminal fittings 20A–20E are installed on the housing 11 by press-fitting a part of each thereof into the housing 11, but they may be installed on the housing 11 by other methods. For example, they may be incorporated integrally with the housing 11 by insert molding.

(3) In the above-described embodiment, one noise-reducing member 30 is installed on one terminal fitting 20C. But within the present invention, a plurality of the noise-reducing members 30 may be installed on one connector. Further, a plurality of terminal fittings or other conductors may be secured to one electrical noise-reducing member by inserting the conductors thereinto; in this case, the body of magnetic material may have a plurality of through-holes each containing an elastically deformable member gripping the respective electrical conductor in the through-hole, or the body may have one through-hole having an elastically deformable member itself having plural through-holes gripping the respective electrical conductors.

Figure 3:
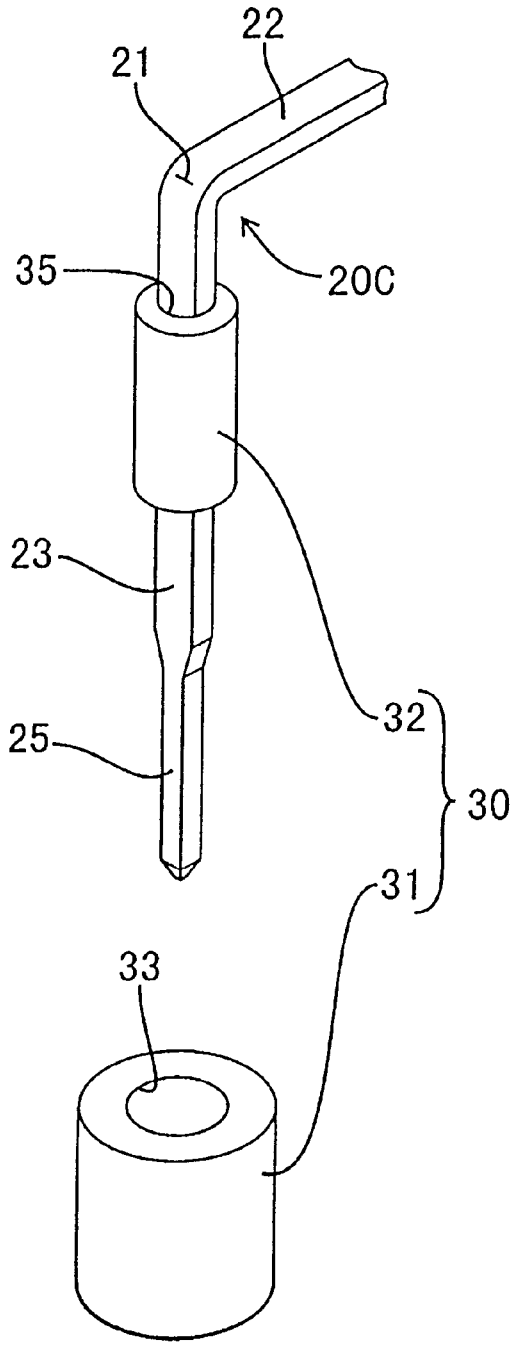
FIG. 3 is a perspective view of another method of installing the noise-reducing member on a conductive wire.

(4) In the above-described embodiment, the noise-reducing member 30 is installed on the terminal fitting 20C by a particular method, but the installing procedure is not limited to that described. For example, as shown in FIG. 3, the noise-reducing member may be formed in situ by inserting the terminal fitting 20C into the through-hole 33 of the magnetic material 31, the installing material 32 being pre-mounted on the terminal fitting 20C and being pressed into the through-hole 33 during the insertion.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

What is claimed is:

1. An electrical noise-reducing assembly, comprising:

(i) at least one elongate electrical conductor; and (ii) a removable electrical noise-reducing member carried on said at least one electrical conductor and comprising a body of magnetic material having at least one through-hole, through which said electrical conductor extends, and an elastically deformable member fixed in said through-hole and elastically gripping said electrical conductor therein so as to hold said body of magnetic material in position on said electrical conductor.

2. An electrical noise-reducing assembly according to claim 1, wherein said body of magnetic material and said elastically deformable member are both circularly cylindrical.

3. An electrical noise-reducing assembly according to claim 1, having a plurality of said electrical conductors, wherein said body of magnetic material has a plurality of said through-holes through which said electrical conductors respectively extend, and a plurality of said elastically deformable members fixed respectively in said through-holes and electrically gripping said electrical conductors.

4. An electrical noise-reducing assembly according to claim 1, wherein said elastically deformable member is made of rubber.

5. An electrical noise-reducing member comprising concentric inner and outer cylindrical portions secured together, wherein said outer cylindrical portion is of electrical noise-reducing magnetic material, and said inner cylindrical portion is of elastically deformable material and has a longitudinal through-hole for elastically securing said inner cylindrical portion to an elongate electrical conductor which, in use, is inserted into said through-hole so that electrical noise in said electrical conductor is reduced.

6. An electrical noise-reducing member according to claim 5, wherein said inner cylindrical portion is made of rubber.

7. An electrical connector comprising an electrical terminal and a removable electrical noise-reducing member carried on said terminal;

said removable electrical noise-reducing member comprising inner and outer portions secured together, wherein said outer portion is of electrical noise-reducing magnetic material and surrounds said inner portion, and said inner portion is of elastically deformable material and has a longitudinal through-hole;

said electrical terminal disposed in said through-hole and elastically secured to said removable electrical noise-reducing member.

8. An electrical conductor according to claim 7, having a body holding said terminal, said electrical noise-reducing member being removably mounted on a portion of said terminal projecting from said body.

* * * * *